US006896353B2

(12) United States Patent
Tee et al.

(10) Patent No.: US 6,896,353 B2
(45) Date of Patent: May 24, 2005

(54) INKJET PRINTHEAD SQUEEGEE

(75) Inventors: Ah Chong Tee, Singapore (SG); Cherng Linn Teo, Singapore (SG); Cheng Tee Tang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/422,223

(22) Filed: Apr. 24, 2003

(65) Prior Publication Data

US 2004/0212657 A1 Oct. 28, 2004

(51) Int. Cl.[7] ..... B41J 2/165
(52) U.S. Cl. ..... 347/33; 347/31
(58) Field of Search ..... 347/33

(56) References Cited

U.S. PATENT DOCUMENTS 4,683,481 A 7/1987 Johnson
5,278,584 A 1/1994 Keefe
6,132,026 A 10/2000 Taylor
6,527,362 B2 * 3/2003 Hood et al. ..... 347/33
6,679,579 B1 * 1/2004 Tee et al. ..... 347/33

FOREIGN PATENT DOCUMENTS

JP 04037555 A * 2/1992 ..... B41J/2/165
JP 06023999 A * 2/1994 ..... B41J/2/165

* cited by examiner

*Primary Examiner*—Stephen D. Meier
*Assistant Examiner*—Ly T Tran

(57) ABSTRACT

An inkjet printhead squeegee is split on one side so that its wiping force on a printhead is highest on the front stroke and much lighter on the backstroke when the surface is dry. Alternatively, the split can be arranged so that the front stroke is light enough to leave the printhead wet, and then the backstroke is much firmer to completely squeegee the printhead dry. The result is high pressure strokes on a dry printhead are avoided.

5 Claims, 5 Drawing Sheets

INKJET PRINTHEAD SQUEEGEE

BACKGROUND

1. Field of the Invention

The embodiments of the present invention relate generally to inkjet printing mechanisms, and in particular to squeegees for wiping excess ink off inkjet printheads.

2. Background of the Invention

Inkjet printheads eject controlled sprays of ink onto a page while printing. Each such printhead has very small nozzles through which drops of various colored ink are fired. To print a typical image, the printhead is moved back and forth across a page, while ejecting patterns of ink drops. Conventional printheads use piezo-electric and thermal printhead technology. For instance, thermal ink ejection mechanisms are shown in U.S. Pat. No. 5,278,584 issued to Brian J. Keefe et al on Jan. 11, 1994 and U.S. Pat. No. 4,683,481, issued to Samuel A. Johnson on Jul. 28, 1987.

A wiper assembly mechanism is typically mounted within the housing of the printing mechanism to clean and protect the printhead. The printhead can be moved over the assembly for maintenance, specifically for wiping off ink residues and any paper dust or other debris that have collected on the printhead.

A wiping sequence generally includes a forward and a backward wiping stroke. In the forward stroke, a wiper blade of the wiper assembly moves from its home position and across the printhead to scrape off ink residues from the printhead. After the forward stroke, the wiper blade moves back to its home position in the backward stroke and wipes the printhead a second time.

In the forward stroke, most ink residues on the printhead are wiped off, and such wets one side of the wiper blade. On the backward stroke, a dry wiping of the printhead occurs if no other fluids are used to moisten the wiper blade. Dry wiping of the printhead can damage the nozzles on the printhead and the wiper blade itself. What is needed is a squeegee and method that reduce or prevent such printhead wear and damage.

SUMMARY OF THE INVENTION

Briefly, a squeegee embodiment of the present invention includes a set of wiper blades that bend over easier to one side than the other. The wiper blades are arranged in conjunction with an inkjet printhead so that the direction that requires the higher force is the one used when the printhead is wet with excess ink. The easy-to-bend direction is used for the backstroke when the printhead is driest.

An advantage of embodiments of the present invention is a squeegee is provided for an inkjet printhead to clean off excess ink.

Other aspects and advantages of the invention will become apparent from the following detailed description, taken in conjunction with the accompanying drawings, which description illustrates by way of example the principles of the invention.

DETAILED DESCRIPTION

Figure 1:
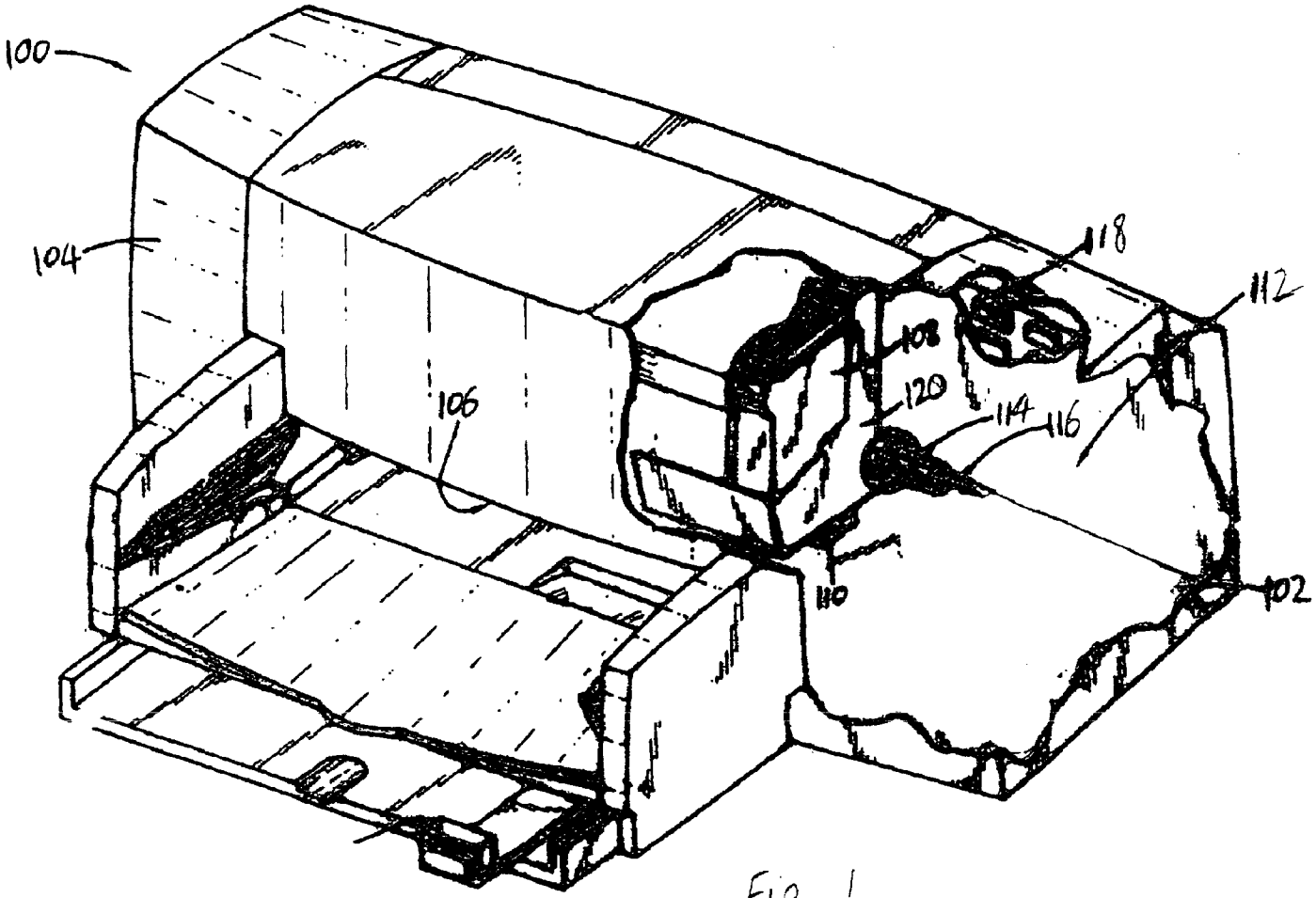
FIG. 1 is a perspective diagram of an inkjet printer embodiment of the present invention.

FIG. 1 illustrates an inkjet printer embodiment of the present invention, and is referred to herein by the general reference numeral 100. The printer 100 is representative of the many kinds of devices that use inkjets and spittoon reservoirs, and that can therefore benefit from embodiments of the present invention. For example, some inkjet-based fax and copier machines are included in alternative embodiments of the present invention.

The typical inkjet printer 100 includes a chassis 102 surrounded by a housing or casing enclosure 104. Sheets of paper are typically fed through a print zone 106 for printing as they pass by an inkjet and carriage assembly. Printer 100 includes an inkjet cartridge 108, a thermal printhead 110, a servicing region 112, a sliding carriage guide rod 114, a scanning axis 116, and a printer controller 118 that receives print-job instructions from a host computer. The sliding carriage guide rod 114 mounted on chassis 102 allows an inkjet carriage 120 to slide back and forth across the print zone 106. The scanning axis 116 is defined by the guide rod 114. Carriage-position information feedback can be provided to the printer controller 118 by an optical encoder reader mounted to the carriage 120. Such typically reads an encoder strip that extends along the path of carriage travel.

The carriage 120 moves across the guide rod 114 to the servicing region 112 inside the casing 104. Wipers and drain basins within the servicing region 112 are used to keep the inkjet cartridge clean and disposes of excess ink that is wiped off.

After arriving inside the print zone 106, each sheet of paper is printed with ink squirted from the inkjet cartridge 108. Such cartridge 108 is sometimes called a "pen" by artisans. The inkjet cartridge 108 includes a supply of ink, a printhead 110 with an orifice plate, and a plurality of nozzles. The printhead 110 illustrated in FIG. 1 represents a thermal inkjet printhead, although other types of printheads may be used, such as piezoelectric printheads.

The outer surface of the orifice plate of the printhead 110 preferably lies in a common printhead plane. In one embodiment, such printhead plane extends substantially horizontally.

Here, only some of the pen servicing functions are discussed, e.g., wiping of the printhead 110. The wiping can be performed by a wiper assembly incorporated in a service station like that illustrated in U.S. Pat. No. 6,132,026, issued to Bret K. Taylor et al on Oct. 17, 2000. Alternatively, the wiper assembly can be mounted independently on the chassis.

Figure 2:
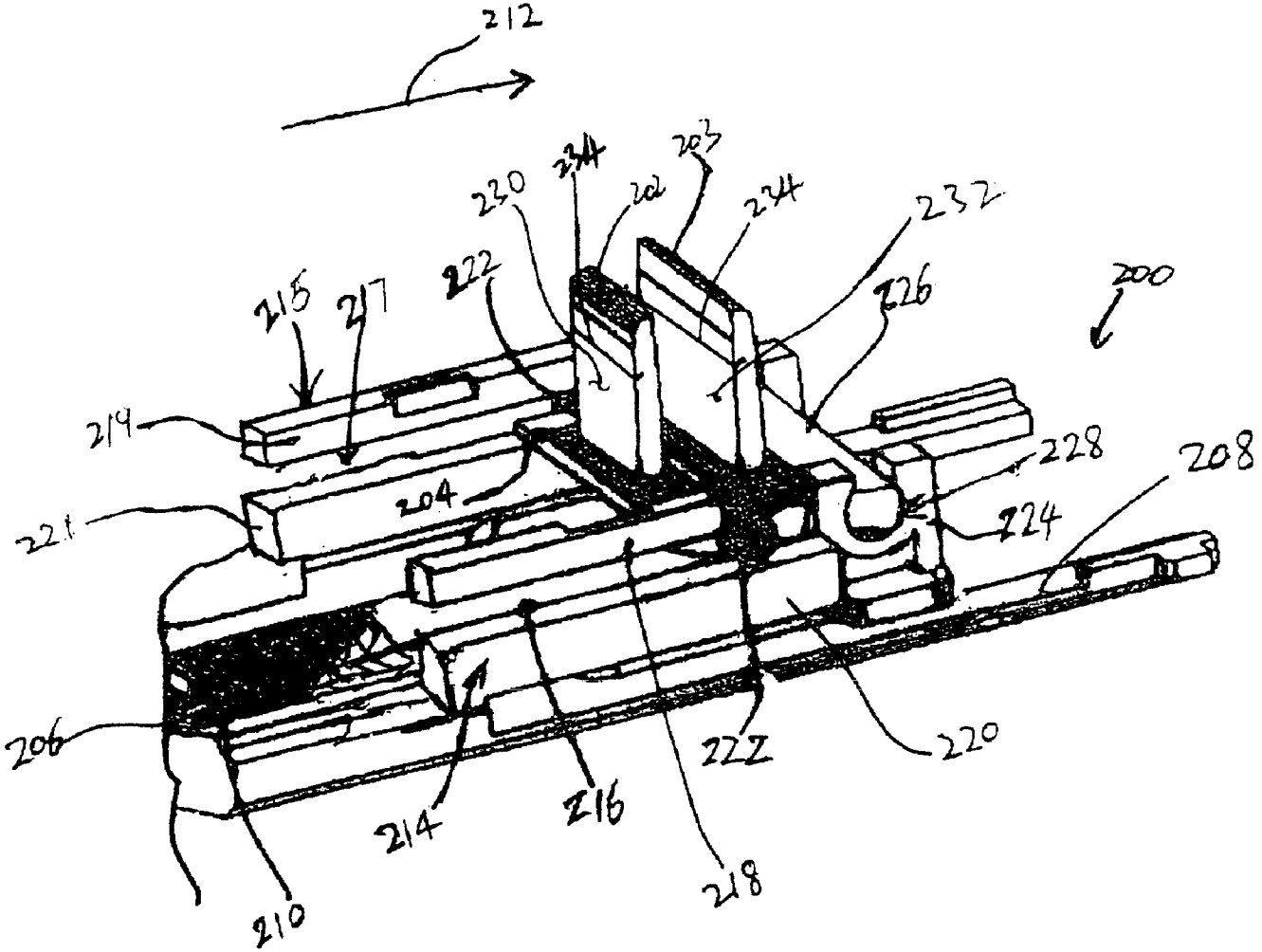
FIG. 2 is a diagram of a wiper assembly embodiment useful in the printer embodiment of FIG. 1.

FIG. 2 represents a wiper assembly 200 which can be separated from a service station and mounted independently on the printer chassis.

The wiper assembly 200 is mounted in the servicing region beneath the printhead in a position for wiping. It includes a pair of wiper blades 202 and 203, e.g., made of ethylene-propylene-diene-monomer (EPDM). Each wiper blade 202 and 203 acts as a squeegee to wipe excess ink off a printhead. Each wiper blade extends vertically up to the printhead plane from a platform 204.

A wiping of the printhead occurs when a rack 206 connected to the platform 204 moves along a slot defined within a base frame 208 of the wiper assembly. The rack 206 is driven back and forth along the slot by a wiper gear which meshes with the rack gear 210. The wiper gear is turned by a motor in the printer through a gear train. Both the slot and the rack 206 lie parallel to the nozzles of the printhead 110. Such is substantially parallel to the media advancement direction 212, in which the media sheet is advanced through the print zone 106 (FIG. 1) during printing operations.

A pair of frames 214 and 215 are respectively located at two sides of the base 208. They project up from and along the rack 206. A pair of guide track slots 216 and 217 are defined by tops of frames 218 and 219, and the bottom edges of frames 220 and 221. On the other hand, the platform 204 has two projections 222 at two respective sides for fitting into the slots 216, 217. In this way, the platform 204 is restricted to slide along the slots during the wiping process.

Rack 206 has a support 224, which extends upward and is mounted on the rack 206 at an end away from the rack gear 210. A pivot arm 226 at an end of the platform 204 fits into a pivot slot 228 at an end of the support such that the platform 204 is mounted to the support 224. In this way, when the rack 206 slides back and forth along the slot (not shown), the platform 204 moves accordingly as driven by the support 224.

Each wiper blade 202 and 203 has a slit 234 on one of its side walls 230, 232. Each slit 234 extends substantially parallel to the printhead plane in a widthwise direction as shown in FIG. 2. Slit 234 on an elastic wiper blade causes the stiffness of the wiper blade to be different during the front and back strokes of the wiping action. The change in wiper blade stiffness puts less pressure on the printhead when the previous stroke has already dried it.

In one embodiment, the forward stroke is defined as being the first squeegee stroke across the printhead. The backward stroke returns it to the home position.

Figure 3A:
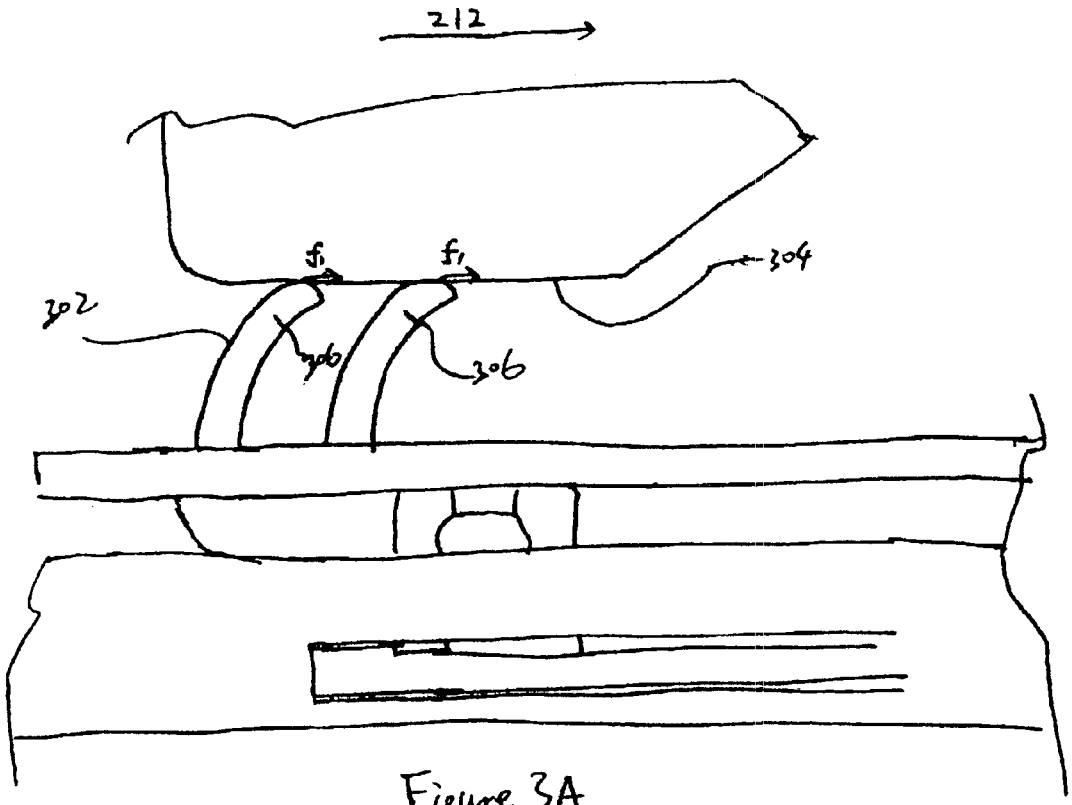
FIGS. 3A and 3B are side view diagrams that illustrate the wiping of a printhead during forward and back strokes by using a squeegee embodiment of the present invention in the printer of FIGS. 1 and 2.

In the forward stroke represented in FIG. 3A, the wiper blade 302 exerts a force F1 on the printhead 304. This closes up slits 306 and increases the stiffness of the wiper blades 302. As a result, the wiper blade 302 exerts maximum pressure and a maximum wiping force on the printhead 304.

Figure 3B:
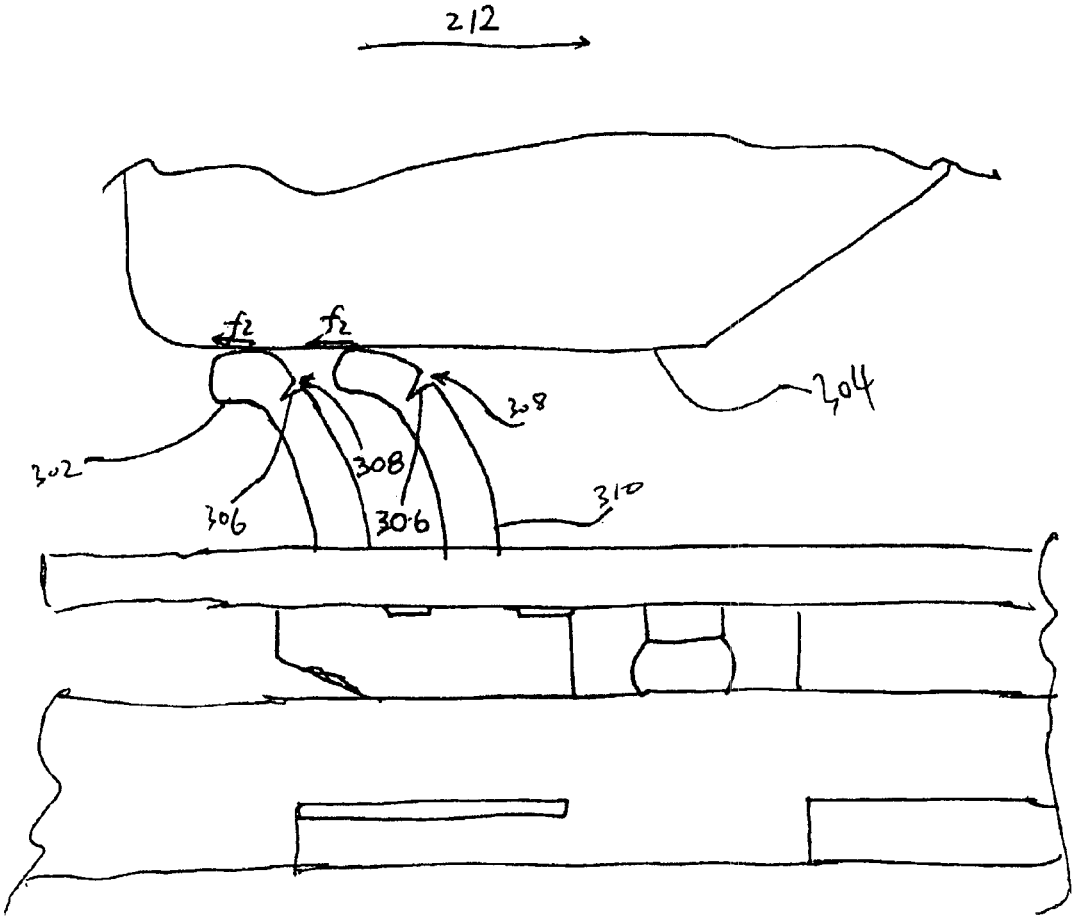

In the backward stroke represented in FIG. 3B, the force F2 on the wiper blade 302 exerted by the printhead 304 widens the opening 308 of each slit 306 on the back wall 310 of the respective wiper blade 302. In this direction, the wiper blades 302 are not as stiff, so each wiper blade 302 applies a minimum of wiping force on the printhead.

In one embodiment of the present invention, each slit 306 runs the full end-to-end width of its respective wiper blades 302. The depth of each slit is about three-fifths of the thickness of its respective wiper blade. The spacing between each slit 306 and the platform is about four-sevenths of the height of its respective wiper blade. Such depths and spacings control the amount of the wiping force that will be applied on the printhead during the backward stroke. The geometry and placement of the slits and the material of the wiper itself can be used to adjust such backstroke wiping force.

Figure 4A:
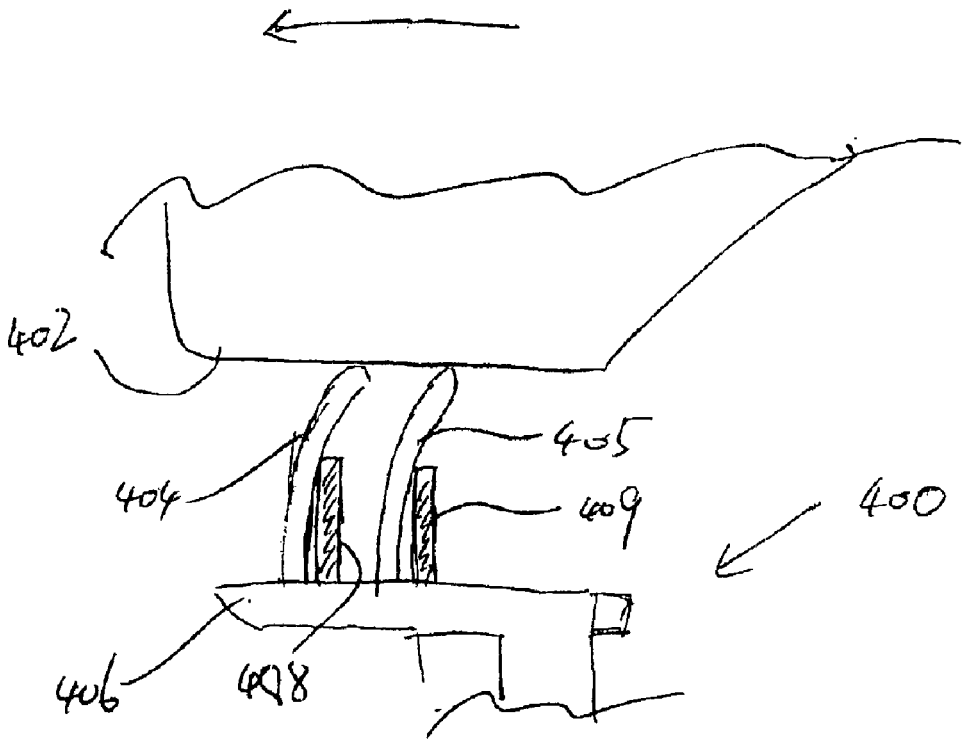
FIGS. 4A and 4B are side view diagrams that partially illustrate the wiping of a printhead during forward and back strokes by using another wiper embodiment of the present invention useful in the printer embodiment of FIG. 1.
Figure 4B:
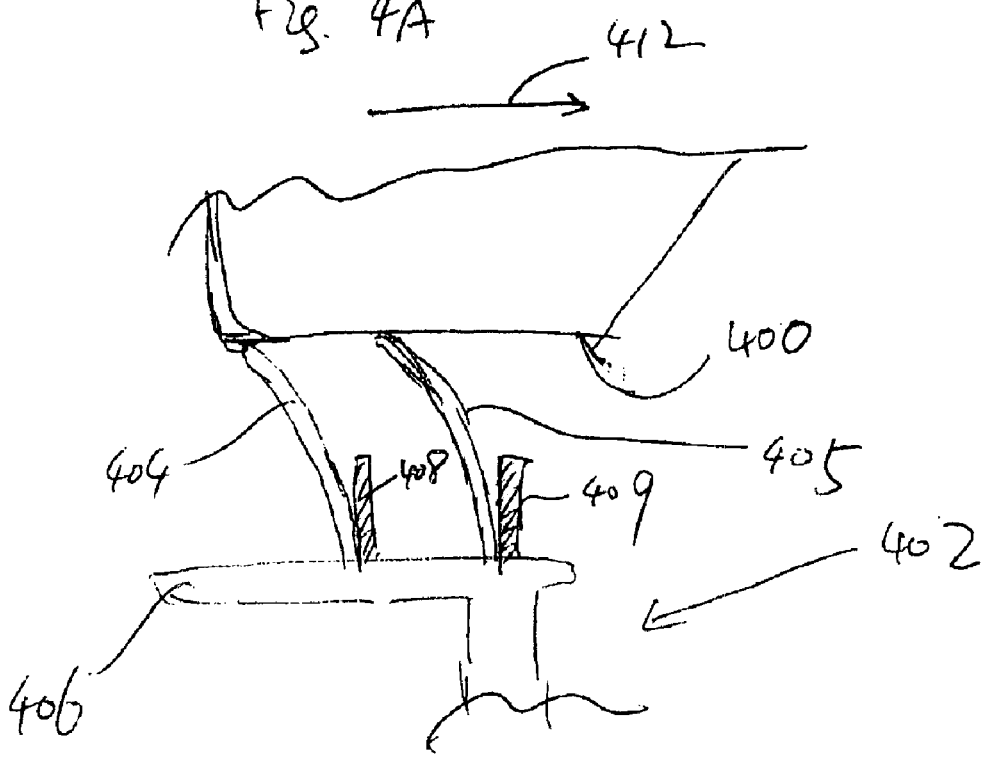

FIGS. 4A and 4B represent another inkjet and wiper assembly embodiment of the present invention, and is referred to herein by the general reference numeral 400. A printhead 402 moves back and forth in relation to a pair of wipers 404 and 405 mounted to a platform 406. The wiper assembly embodiment 400 is similar to that of FIG. 2. Each wiper blade 404 and 405 acts as a squeegee to wipe excess ink off the printhead. A pair of rigid columns or buttresses 408 and 409 are fixedly mounted to the platform 406. Each buttress 408 and 409 extends substantially parallel to its respective wiper blade but is shorter in height than the wiper blades 404 and 405. Furthermore, each buttress 408 and 409 is placed behind and in close proximity to its respective wiper blade 404 and 405 in the forward wiping direction of the forward stroke as illustrated by FIG. 4A.

In the forward stroke of FIG. 4A, each wiper blade 404 and 405 is bent over by the printhead 402 and comes into contact with its respective buttress 408 and 409 due to the wiping direction and the position of the buttresses. The bottom part of each wiper blade 404 and 405 is then restricted from further bent-over by the buttresses 408 and 409. In this way, the effective stiffness of the wiper blades 404 and 405 is increased during the forward stoke. As a result, the wiper blades 404 and 405 exert a maximum pressure and wiping force on the printhead 402 during its forward stroke.

In the backward stroke represented in FIG. 4B, each buttress 408 and 409 does nothing to restrict the flexing of wiper blades 404 and 405 in a direction opposite to the backward wiping direction 412. Each wiper blade 404 and 405 flexes away from its corresponding buttress 408 and 409. Therefore, during the backward stroke, the wiper blades have a relatively low effective stiffness as compared to the forward stroke. In this way, each wiper blade 404 and 405 is manipulated to apply a minimum of wiping force on the printhead 402 during the backward stroke.

Alternatives can be made. For example, the buttresses 408 and 409 can be made of flexible materials. Each buttress mainly functions to increase the effective stiffness of its respective wiper blades during the forward stroke by applying an additional force on the wiper blade.

What is claimed is:

1. A method for wiping an inkjet printhead, comprising:

providing at least one squeegee for wiping an inkjet printhead, said squeegee having a sidewall with a slit formed therein, said slit being closed when the squeegee is at a home position;

applying a forward stroke of said squeegee from the home position and across said printhead such that said slit is closed and a higher of two pressures is applied to wipe off excess ink; and applying a return stroke of said squeegee back to its home position such that said slit is opened up and a lesser wiping force from a lower of said two pressures is applied to said printhead when said printhead is already dry of ink.

2. The method of claim 1, wherein:

the forward stroke is such that said higher of two pressures for wiping includes bending said squeegee in a first stiffer direction; and the return stroke is such that said lower of two pressures for wiping includes bending said squeegee in a second less stiff direction.

3. The method of claim 1, wherein:

the forward stroke is such that said higher of two pressures for wiping causes said squeegee to flex in a first direction; and the return stroke is such that said lower of two pressures for wiping causes said squeegee to flex in a second direction.

4. A method for wiping an inkjet printhead, comprising:

providing at least one wiper blade, said wiper blade having a sidewall with a slit formed therein, said slit being closed when the wiper blade is in a non-wiping position;

wiping the printhead with a forward stroke of the wiper blade across the printhead such that the wiper blade is flexed in a first direction and the slit is closed, whereby a higher of two wiping forces is applied to wipe off excess ink from the printhead; and wiping the printhead with a return stroke of the wiper blade such that the wiper blade is flexed in a second direction and the slit is opened up, whereby a lower of two wiping forces is applied to the printhead.

5. An inkjet printer, comprising:

a printhead mounted on a carriage that is operable to move the printhead to a wiping position;

a squeegee mounted on a movable platform and arranged so as to wipe off excess ink from the printhead when the printhead is in the wiping position, said platform being movable in a forward direction during a forward wiping stroke and in a backward direction during a backward wiping stroke, said squeegee having a height that extends from the platform and a sidewall with a slit formed therein, wherein said slit is closed when the squeegee is in a non-wiping position, and is positioned at a location along the height of the squeegee so that said forward wiping stroke applies a wiping force to the printhead that is higher than a wiping force applied by said backward wiping stroke.

* * * * *